US010344400B2

(12) United States Patent
Yang et al.

(10) Patent No.: US 10,344,400 B2
(45) Date of Patent: Jul. 9, 2019

(54) MELT DIFFERENTIAL ELECTROSPINNING DEVICE AND PROCESS

(71) Applicant: Beijing University of Chemical Technology, Beijing (CN)

(72) Inventors: Weimin Yang, Beijing (CN); Haoyi Li, Beijing (CN); Zhiwei Jiao, Beijing (CN); Xiangfeng Zhong, Beijing (CN); Hua Yan, Beijing (CN); Pengcheng Xie, Beijing (CN); Ying An, Beijing (CN); Yumei Ding, Beijing (CN); Jing Tan, Beijing (CN); Hongbo Chen, Beijing (CN)

(73) Assignee: Beijing University of Chemical Technology, Beijing (CN)

( * ) Notice: Subject to any disclaimer, the term of this patent is extended or adjusted under 35 U.S.C. 154(b) by 551 days.

(21) Appl. No.: 14/888,059

(22) PCT Filed: Apr. 28, 2014

(86) PCT No.: PCT/CN2014/076385

§ 371 (c)(1),
(2) Date: Oct. 29, 2015

(87) PCT Pub. No.: WO2014/177039

PCT Pub. Date: Nov. 6, 2014

(65) Prior Publication Data

US 2016/0068999 A1 Mar. 10, 2016

(30) Foreign Application Priority Data

May 3, 2013 (CN) ..... 2013 1 0159564
May 3, 2013 (CN) ..... 2013 1 0159570
Nov. 11, 2013 (CN) ..... 2013 1 0556271

(51) Int. Cl.
*D01D 5/00* (2006.01)

(52) U.S. Cl.
CPC ..... *D01D 5/0092* (2013.01); *D01D 5/0023* (2013.01); *D01D 5/0069* (2013.01)

(58) Field of Classification Search
CPC ... D01D 5/0092; D01D 5/0069; D01D 5/0023
See application file for complete search history.

(56) References Cited

U.S. PATENT DOCUMENTS 6,641,773 B2 11/2003 Kleinmeyer et al.
7,086,846 B2 8/2006 Kleinmeyer et al.
(Continued)

FOREIGN PATENT DOCUMENTS

CN 1749449 A 3/2006
CN 100593592 C 3/2010
(Continued)

*Primary Examiner* — Robert J Grun
(74) *Attorney, Agent, or Firm* — Rudy J. Ng; Bret E. Field; Bozicevic, Field & Francis LLP

(57) ABSTRACT

A melt differential electrospinning device and process, the melt differential electrospinning device comprising a spinning nozzle (1), a fiber receiving device (3), a first high-voltage electrostatic generator (6), a second high-voltage electrostatic generator (7), a grounding electrode (5), and n layers of electrode plates of a first electrode plate (2) and a second electrode plate (4), n being an integer greater than or equal to 2; the spinning nozzle comprises a splitter plate (21), a nut (22), a spring spacer (23), an air pipe positioning pin (24), a screw (25), a nozzle body positioning pin (26), a nozzle body (27), an air pipe (28), a heating device (29), a temperature sensor (210) and an inner cone nozzle (211). The melt differential electrospinning process employs the melt differential electrospinning device, such that the polymer melt, under the effect of a wind field and an electric field, is uniformly distributed into a circle of dozens of Taylor cones along the conical surface end, and is further formed into dozens of jet flows and refined into nanofibers; and a plurality of melt differential electrospinning nozzles
(Continued)

are installed below the splitter plate, thus realizing large-scale production of nanofibers, with a simple structure, and easy machining and assembly of components.

18 Claims, 6 Drawing Sheets

(56) References Cited

U.S. PATENT DOCUMENTS

| | | | |
|---|---|---|---|
| 7,887,311 | B2 | 2/2011 | Chu et al. |
| 7,934,917 | B2 | 5/2011 | Chu et al. |
| 2002/0089094 | A1 | 7/2002 | Kleinmeyer et al. |
| 2002/0175449 | A1 | 11/2002 | Chu et al. |
| 2004/0061253 | A1 | 4/2004 | Kleinmeyer et al. |
| 2006/0049542 | A1 | 3/2006 | Chu et al. |
| 2009/0121379 | A1 | 5/2009 | Chu et al. |
| 2009/0123591 | A1 | 5/2009 | Chu et al. |

FOREIGN PATENT DOCUMENTS

| | | | |
|---|---|---|---|
| CN | 101985778 | A | 3/2011 |
| CN | 102839431 | A | 12/2012 |
| CN | 102864502 | A | 1/2013 |
| CN | 103215663 | A | 7/2013 |
| CN | 103225116 | A | 7/2013 |
| CN | 103243397 | A | 8/2013 |
| CN | 203238357 | U | 10/2013 |
| CN | 103572387 | A | 2/2014 |
| CN | 103668486 | A | 3/2014 |
| CN | 203583023 | U | 5/2014 |
| JP | 2008223186 | A | 9/2008 |

MELT DIFFERENTIAL ELECTROSPINNING DEVICE AND PROCESS

FIELD OF THE INVENTION

The present invention relates to the field of electrospinning, and in particular, to a melt differential electrospinning device and a melt differential electrospinning process.

BACKGROUND OF THE INVENTION

With the wide application of nano-technologies, methods for preparing nanofibers via electrospinning are getting more and more attentions in experimental study and industrialized development. Due to its moderate preparation process and nano-level fiber fineness, solution electrospinning attracts deep study and wide application, and batch production is preliminarily realized at present. However, due to the use of solvents, the industrialization continuity, the production environment and the application in medical areas are limited; and because problems of noxious solvent recovery, low strength of porous fiber, being difficult to prepare PP and PE fiber and low efficiency, etc., exist in solution electrospinning, the industrialized application of solution electrospinning technologies is limited. No solvent is used in melt electrospinning, so it has an intrinsic safety, and the fiber prepared by melt electrospinning may reach several hundreds of nanometer, which is one order of magnitude less than the fineness of fiber prepared by the traditional melt blowing technology. Therefore, melt electrospinning may be regarded as a reliable technology for realizing the environment-friendly production of high-performance nanofibers.

In 1981, Larrondo and Manley reported a electrospinning of polymer melt for the first time, and they designed a melt electrospinning device in which the melt is extruded via a piston and the collection distance for the electrospun fiber is 3 cm. When electrospinning PP by this device, fibers with a diameter of about 50 μm can be prepared successfully.

Naoki SHIMADA, et al. from Japan prepares a row of fibers by heating a membrane to a very low viscosity via a customized line laser light source, thus the output of fibers is increased based on the original point light source, but the cost is still very high, and the output is low, thereby it is difficult to realize batch production.

Michal KOMAREK and Lenka MARTINOVA from Czech Republic University, Czech Republic proposed a slit-type spinning device, but such a spinning device cannot well solve the uniform distribution of melt at the slit, and the number of threads is not enough for industrialized application.

US Patent US20090121379A1 proposed electrically-assisted melt blowing and hot air-assisted electrospinning, wherein the high-speed stretching effect of hot air and the unstable refining effect of electric field force are combined, and the jet flow speed of the single thread is increased under the action of hot air blowing, and the fiber fineness is made to reach about 200 nm under the action of the electric field force; however, the nozzle used in this patent is a single nozzle for single jet generation and its improvement, and the embodiments are only directed to solution spinning, moreover, only methods are put forward for melt spinning, which is limitative for industrialized application.

Yao Yongyi et al., from Sichuan University mentions an air flow-electrospinning machine in document "Electrospinning Method And Air Flow-Electrospinning Method For Preparing Polysulfone Nanofibers", wherein, an air passage system is wrapped outside an ordinary single-needle nozzle, and the jet flow is stretched by a resultant force of the electrostatic force and the friction force between the air flow and the polymer jet flow, thereby the fibers spun are refined, however, the structure of the nozzle is complex, which is adverse to industrialized application, and moreover, a set of air supply device needs to be added additionally, thus the cost will be added, and the energy consumption will be large.

Xia Lingtao et al. from Beijing University of Chemical Technology mentions the modification of polypropylene by a super-branched polymer in document "Application Of Super-Branched Polymer In Melt Electrospinning", thereby the viscosity of polypropylene melt may be lowered, and the fiber spun will be finer.

At present, the key problem to be solved for melt electrospinning is how to further decrease the micrometer-level fiber diameter to hundred nanometer-level (submicrometer-level) fiber diameter and how to further increase the production efficiency of melt electrospinning for industrialization.

Therefore, the diameter of fibers produced by the existing melt electrospinning device is large, and it is difficult for industrialized application.

SUMMARY OF THE INVENTION

The present invention provides a melt differential electrospinning device and a melt differential electrospinning process, thereby realizing the batch production of nanofiber or fiber refining.

The invention provides a melt differential electrospinning device, which includes:

a spinning nozzle;

a fiber receiving device;

a first high-voltage electrostatic generator, a second high-voltage electrostatic generator and a grounding electrode;

n layers of electrode plates including a first electrode plate and a second electrode plate, which are set under the spinning nozzle, with n being an integer greater than or equal to 2;

Wherein, the first electrode plate is an electrode plate with holes in the middle thereof, the spinning nozzle is connected with the grounding electrode, the first electrode plate is mounted at a certain distance under the spinning nozzle, the first electrode plate is connected with a high-voltage positive terminal of the first high-voltage electrostatic generator, the second electrode plate is mounted at a certain distance under the first electrode plate, and the second electrode plate is connected with a high-voltage positive terminal of the second high-voltage electrostatic generator.

Moreover, the fiber receiving device is a flat plate, or a mesh placement apparatus, or a roller; the fiber receiving device is placed above the second electrode plate; or the second electrode plate is substituted with the electrode plate with holes in the middle thereof, and the collection of fibers is realized under the second electrode plate.

Moreover, the spinning nozzle includes: a hopper, a feed cylinder, a nozzle body, a first nozzle, an airflow channel air-supply pipe, an airflow channel stand pipe, an airflow channel heat-insulating layer, a nozzle inner body, a key, a jack screw, a heating device, a temperature sensor, a threaded rod, a shaft coupling, a servo motor and a motor support; wherein the airflow channel stand pipe and the nozzle inner body are connected via screw thread and mounted in the nozzle body, the key is mounted between the airflow channel stand pipe and the nozzle body to position the airflow channel stand pipe and the nozzle body, the airflow channel air-supply pipe passes through the nozzle body and is connected with the airflow channel stand pipe via screw thread, the airflow channel heat-insulating layer is located in the airflow channel stand pipe and the nozzle inner body, the first nozzle is connected with the nozzle body via screw thread, the jack screw is mounted on the nozzle body, the jack screw is uniformly distributed along the periphery, the jack screw jacks the nozzle inner body to adjust the uniformity of the annular gap between the nozzle body and the nozzle inner body, the feed cylinder is connected with the nozzle body via a screw, the hopper is connected with the feed cylinder via screw thread, the threaded rod is located in the feed cylinder, and the threaded rod is connected with the servo motor via the shaft coupling, the servo motor is mounted on the motor support, and the servo motor is fixed on the flat plate of the feed cylinder via a screw; the first nozzle is connected with the grounding electrode, the airflow channel air-supply pipe is connected with an external hot air source, and the heating device and the temperature sensor are connected with a temperature control box.

Moreover, the spinning nozzle includes: a splitter plate, a nut, a spring spacer, an air pipe positioning pin, a screw, a nozzle body positioning pin, a nozzle body, an air pipe, a heating device, a temperature sensor and a first nozzle; wherein, the splitter plate is located above the nozzle body, the nozzle body and the splitter plate are positioned via the nozzle body positioning pin, the nozzle body and the splitter plate are connected via a screw, the nozzle body is set with an oblique flow passage through which the melt flows, the splitter plate is set with a subchannel, and the inlet of the oblique flow passage on the splitter plate is in communication with the outlet of the subchannel on the splitter plate; a hole for a gas to pass through is set inside the air pipe, the hole at the air outlet inside the air pipe is a coniform hole, the air pipe is mounted in the inner hole of the nozzle body and the splitter plate, an annular gap in which the melt flows is formed between the external surface of the air pipe and the inner hole of the nozzle body; the air pipe is connected with an air duct of external hot air source via the screw thread on the upmost thereof, the top of the air pipe is fixed with the spring spacer via a nut; a key groove is further opened on the top part of the air pipe, and an air pipe positioning pin or a key is mounted in the key groove; the first nozzle and the nozzle body are connected via screw thread; a heating device is wrapped outside the nozzle body and the splitter plate, and a temperature sensor is mounted for temperature control; and the first nozzle is connected with the grounding electrode.

Moreover, the subchannels on the splitter plate are a plurality of subchannels that are distributed uniformly, and a plurality of spinning nozzles are mounted under one splitter plate.

Moreover, the first nozzle is an inner cone nozzle, the bottom end of the air pipe is further connected with a male cone nozzle via screw thread, a circular hole and a coniform hole for a gas to pass through are set inside the male cone nozzle, the inner cone nozzle is sleeved outside the male cone nozzle, the spinning material melt flows along the passage to the annular gap between the air pipe and the inner hole of the nozzle body and finally flows onto the male cone of the male cone nozzle and the inner cone of the inner cone nozzle.

Moreover, the first nozzle is an inner cone nozzle, the spinning material melt flows along the passage to the annular gap between the air pipe and the inner hole of the nozzle body and finally flows onto the inner cone of the inner cone nozzle; or, the first nozzle is a male cone nozzle, the spinning material melt flows along the passage to the annular gap between the air pipe and the inner hole of the nozzle body and finally flows onto the male cone of the male cone nozzle.

Moreover, the material is fed at the center of the feed cylinder and wind is fed at the side edge of the feed cylinder, the wind fed at the side edge passes through the airflow channel stand pipe and then blows downward verticality onto the inner cone of the first nozzle, and the first nozzle is an inner cone nozzle.

The invention further provides a melt differential electrospinning process, which employs the above melt differential electrospinning device;

Wherein, a polymer melt is provided to the splitter plate via a polymer melt plasticizing and supplying device, wherein: the external hot air source is turned on to supply hot air at a certain temperature into the air pipe; after being split by the subchannels in the splitter plate, the polymer melt flows into the oblique flow passage of the nozzle body, then flows into the annular gap between the air pipe and the inner hole of the nozzle body, and finally flows onto the cone of the first nozzle; the first high-voltage electrostatic generator and the second high-voltage electrostatic generator are turned on in turn to form a high-voltage electrostatic field between the first electrode plate and the first nozzle and between the first electrode plate and the second electrode plate, the spinning material melt is uniformly distributed into a circle of dozens of Taylor cones along the lower end of the lateral side of the first nozzle, thereby the spinning material melt is jetted into threads; then, under the combined action of the wind field and the electric field force, the threads pass through the holes on the first electrode plate and fall onto a fiber receiving plate; by setting a plurality of electrode plates with holes in the middle thereof under the melt differential spinning nozzle, multiple levels of electric fields are formed, and the threads spun by the melt differential spinning nozzle are extended for multiple times; the fiber fineness is adjusted and controlled by controlling the distance between the electrode plates and the voltage applied on the electrode plate.

The invention further provides a melt differential electrospinning device, which mainly includes: a spinning nozzle, a first electrode plate, a second electrode plate, a first high-voltage electrostatic generator, a second high-voltage electrostatic generator, a fiber receiving device and a grounding electrode, wherein, the first electrode plate is an electrode plate with holes in the middle thereof, the second electrode plate is an electrode plate without holes in the middle thereof; the spinning nozzle is connected with the grounding electrode, the first electrode plate is mounted at a certain distance under the spinning nozzle, the first electrode plate is connected with a high-voltage positive terminal of the first high-voltage electrostatic generator, the second electrode plate is mounted at a certain distance under the first electrode plate, the second electrode plate is connected with a high-voltage positive terminal of the second high-voltage electrostatic generator, and the fiber receiving device is placed above the second electrode plate.

Moreover, the second electrode plate is an electrode plate with holes in the middle thereof, and at this time, the collection of fibers is realized under the second electrode plate, and the fiber collecting device is a flat plate, or a mesh placement apparatus, or a roller.

Moreover, n layers of electrode plates are set under the spinning nozzle, with n being an integer and $n \geq 2$.

Moreover, the spinning nozzle includes: a splitter plate, a nut, a spring spacer, an air pipe positioning pin, a screw, a nozzle body positioning pin, a nozzle body, an air pipe, a heating device, a temperature sensor and an inner cone nozzle; wherein, the splitter plate is located above the nozzle body, the nozzle body and the splitter plate are positioned via the nozzle body positioning pin, the nozzle body and the splitter plate are connected via a screw, the nozzle body is set with an oblique flow passage through which the melt flows, the splitter plate is set with a subchannel, and the inlet of the oblique flow passage on the splitter plate is in communication with the outlet of the subchannel on the splitter plate; a hole for a gas to pass through is set inside the air pipe, the hole at the air outlet inside the air pipe is a coniform hole, the air pipe is mounted in the inner hole of the nozzle body and the splitter plate, an annular gap in which the melt flows between the external surface of the air pipe and the inner hole of the nozzle body; the air pipe is connected with an air duct of external hot air source via the screw thread on the upmost thereof, the top of the air pipe is fixed with the spring spacer via a nut; a key groove is further opened on the top part of the air pipe, and an air pipe positioning pin or a key is mounted in the key groove; the inner cone nozzle is connected with the nozzle body via screw thread; a heating device is wrapped outside the nozzle body and the splitter plate, and a temperature sensor is mounted for temperature control; and the inner cone nozzle is connected with the grounding electrode.

Moreover, the spinning nozzle includes: a hopper, a feed cylinder, a nozzle body, an inner cone nozzle, an airflow channel air-supply pipe, an airflow channel stand pipe, an airflow channel heat-insulating layer, a nozzle inner body, a key, a jack screw, a heating device, a temperature sensor, a threaded rod, a shaft coupling, a servo motor, a motor support, a grounding electrode, a receiving electrode plate and a high-voltage electrostatic generator; wherein the airflow channel stand pipe and the nozzle inner body are connected via screw thread and mounted in the nozzle body, the key is mounted between the airflow channel stand pipe and the nozzle body to position the airflow channel stand pipe and the nozzle body, the airflow channel air-supply pipe passes through the nozzle body and is connected with the airflow channel stand pipe via screw thread, the airflow channel heat-insulating layer is located in the airflow channel stand pipe and the nozzle inner body, the inner cone nozzle is connected with the nozzle body via screw thread, the jack screw is mounted on the nozzle body, the jack screw is uniformly distributed along the periphery, and the jack screw jacks the nozzle inner body to adjust the uniformity of the annular gap between the nozzle body and the nozzle inner body, the feed cylinder is connected with the nozzle body via a screw, the hopper is connected with the feed cylinder via screw thread, the threaded rod is located in the feed cylinder, and the threaded rod is connected with the servo motor via the shaft coupling, the servo motor is mounted on the motor support, and the servo motor is fixed on the flat plate of the feed cylinder via a screw; the inner cone nozzle is connected with the grounding electrode, the receiving electrode plate is fixed at a certain distance under the inner cone nozzle, the receiving electrode plate is connected with the high-voltage positive terminal of the high-voltage electrostatic generator, the airflow channel air-supply pipe is connected with an external hot air source, and the heating device and the temperature sensor are connected with a temperature control box.

Moreover, the subchannels on the splitter plate are a plurality of subchannels that are distributed uniformly, and a plurality of spinning nozzles are mounted under one splitter plate.

Moreover, the material is fed by a threaded rod, or a plunger, or a minitype extruder, or by the self weight of the melt.

Moreover, the inner cone nozzle is substituted with a male cone nozzle, and the male cone nozzle is mounted on the bottom end of the air pipe via screw thread, the melt passes through the male cone of the male cone nozzle, a circular hole and a coniform hole for a gas to pass through are set inside the male cone nozzle, and the grounding electrode is connected with the nozzle body.

Moreover, the bottom end of the air pipe is connected with a male cone nozzle via screw thread, a circular hole and a coniform hole for a gas to pass through are set inside the male cone nozzle.

Moreover, the inner cone nozzle is sleeved outside the male cone nozzle, the spinning material melt flows along the passage to the annular gap between the air pipe and the inner hole of the nozzle body, and finally flows onto the male cone of the male cone nozzle and the inner cone of the inner cone nozzle.

The invention further provides a spinning process of a melt differential electrospinning device, wherein a polymer melt (i.e., a spinning material) is provided to the splitter plate via a polymer melt plasticizing and supplying device, and the external hot air source is turned on to supply hot air at a certain temperature into the air pipe; after being split by the subchannels in the splitter plate, the polymer melt flows into the oblique flow passage of the nozzle body, then flows into the annular gap between the air pipe and the inner hole of the nozzle body, and finally flows onto the cone of the inner cone nozzle; the first high-voltage electrostatic generator and the second high-voltage electrostatic generator are turned on in turn to form a high-voltage electrostatic field between the first electrode plate and the inner cone nozzle and between the first electrode plate and the second electrode plate, the polymer melt is uniformly distributed into a circle of dozens of Taylor cones along the lower end of the lateral side of the inner cone nozzle, thereby the spinning material melt is jetted into threads; then, under the combined action of the wind field and the electric field force, the threads pass through the holes on the first electrode plate and fall onto a fiber receiving plate; by setting a plurality of electrode plates with holes in the middle thereof under the melt differential spinning nozzle, multiple levels of electric fields are formed, and the threads spun by the melt differential spinning nozzle are extended for multiple times; the fiber fineness is adjusted and controlled by controlling the distance between the electrode plates and the voltage applied on the electrode plate.

By setting a plurality of electrode plate with holes in the middle thereof under the spinning nozzle, multiple levels of electric fields are formed, and the threads spun by the spinning nozzle are extended for multiple times, thereby the refining of the fiber is realized; by controlling the distance between the electrode plates and the voltage applied on the electrode plate, the fiber fineness is adjusted and controlled.

During the falling of the fiber, multiple electrodes are employed to extend the fiber, and the fiber spun will be finer. By adjusting the distance between the electrode plate and the inner cone high-efficiency spinning nozzle and the distance between the electrode plates and adjusting the voltage of the high-voltage electrostatic generator, the fiber fineness may be adjusted to a certain degree.

By employing an electrode with holes, the fibers are received under the electrode, and this makes the collection of fibers diversified, and the fibers may be made in bundles during falling via the assistant extending of air flow, which is convenient for being wound for different requirements.

The polymer melt (i.e., spinning material) flows through the inner cone, and finally, under the action of an electric field force, the polymer melt is uniformly distributed into a circle of dozens of Taylor cones along the cone end, and is thereby formed into dozens of jet flows and refined into nanofibers, thus the output of a single melt differential electrospinning nozzle is high; by mounting a plurality of melt differential electrospinning nozzles under the splitter plate, batch production of nanofibers may be realized, and the output of a device with the equivalent scale is one order of magnitude larger than that of an electrospinning device of the same scale.

By grounding the melt differential electrospinning nozzle and connecting the electrode plate to a positive high voltage, it may be effectively avoided that an electric apparatus is influenced and damaged when the nozzle is connected to a high voltage during electrospinning.

By employing a mode in which the material is fed at the center and wind is fed at the side, the melt is uniformly split via the inner cone of the nozzle, the melt on the inner cone is blown thin via the hot air, and the threads are extended and guided to fall via the hot air, wherein the hot air may have a certain heat preservation action on the environment around the threads, the cooling of the threads may be slowed down, the acting time of extension on the threads may be prolonged, and the thread will be finer; a plurality of Taylor cones may be formed on the arris of the inner cone nozzle, thus a nozzle may spin a plurality of threads at a time, and high-efficiency spinning of a single nozzle may be realized.

The device and process of the invention are easy and convenient for implementing, and thus are applicable for laboratory research and industrialized application.

Additionally, the invention can also solve the problems in the prior art of complex structure, high energy consumption and low output.

REFERENCE SIGNS

1—Spinning Nozzle, 2—First Electrode Plate, 3—Fiber Receiving Plate, 4—Second Electrode Plate, 5—Grounding Electrode, 6—First High-Voltage Electrostatic Generator, 7—Second High-Voltage Electrostatic Generator, 8—Third Electrode Plate, 9—Fourth Electrode Plate, 10—Roller, 11—Third High-Voltage Electrostatic Generator, 12—Fourth High-Voltage Electrostatic Generator

21—Splitter Plate, 22—Nut, 23—Spring Spacer, 24—Air Pipe Positioning Pin, 25—Screw, 26—Nozzle Body Positioning Pin, 27—Nozzle Body, 28—Air Pipe, 29—Heating Device, 210—Temperature Sensor, 211—Inner Cone Nozzle, 212—First Electrode Plate, 213—Fiber Receiving Plate, 214—Second Electrode Plate, 215—First High-Voltage Electrostatic Generator, 216—Second High-Voltage Electrostatic Generator, 217—Grounding Electrode, 218—Thread, 219—Third Electrode Plate, 220—Fourth Electrode Plate, 221—Roller, 222—Third High-Voltage Electrostatic Generator, 223—Fourth High-Voltage Electrostatic Generator, 224—Male Cone Nozzle

31—Servo Motor, 32—Shaft Coupling, 33—Motor Support, 34—Hopper, 35—Feed Cylinder, 36—Threaded Rod, 37—Airflow Channel Air-Supply Pipe, 38—Airflow Channel Stand Pipe, 39—Nozzle Body, 310—Nozzle Inner Body, 311—Grounding Electrode, 312—High-Voltage Electrostatic Generator, 313—Receiving Electrode Plate, 314—Inner Cone Nozzle, 315—Heating Device, 316—Temperature Sensor, 317—Airflow Channel Heat-Insulating Layer, 318—Key, 319—Jack Screw

DETAILED DESCRIPTION OF THE EMBODIMENTS

In order to more clearly understand the technical characteristics, the objects and the effects of the invention, the invention will be illustrated in conjunction with the drawings.

Figure 1:
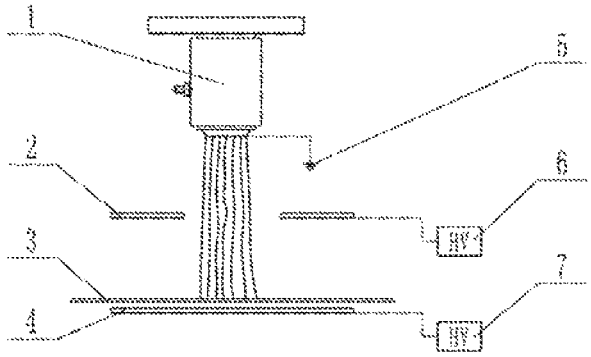
FIG. 1 is a structural representation of a melt differential electrospinning device according to embodiment 1 of the invention.
Figure 2:
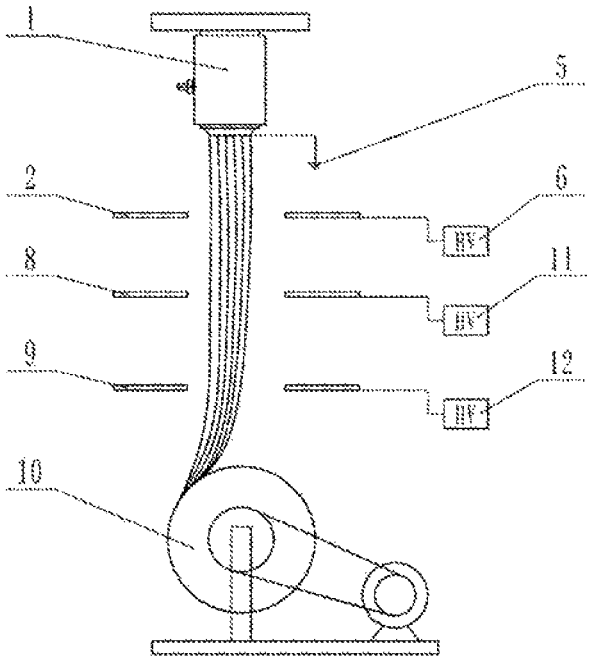
FIG. 2 is a structural representation of a melt differential electrospinning device according to embodiment 2 of the invention.

As shown in FIG. 1, a melt differential electrospinning device according to the invention includes:

a spinning nozzle 1;

a fiber receiving device, for example, the fiber receiving plate 3 in FIG. 1, and the roller 10 in FIG. 2, for receiving the thread or spinning jet by the spinning nozzle 1;

a first high-voltage electrostatic generator 6, a second high-voltage electrostatic generator 7 and a grounding electrode 5;

n layers of electrode plates including a first electrode plate 2 and a second electrode plate 4, which are set under the spinning nozzle, with n being an integer greater than or equal to 2, and in FIG. 1, n is equal to 2, and in FIG. 2, n is equal to 3;

Wherein, the first electrode plate 2 is an electrode plate with holes in the middle thereof, the spinning nozzle 1 is connected with the grounding electrode 5, the first electrode plate 2 is mounted at a certain distance (0.5 to 10 cm) under the spinning nozzle 1, the first electrode plate 2 is connected with the high-voltage positive terminal of the first high-voltage electrostatic generator 6, the second electrode plate 4 is mounted at a certain distance (5 to 70 cm) under the first electrode plate 2, and the second electrode plate 4 is connected with the high-voltage positive terminal of the second high-voltage electrostatic generator 7.

During spinning, after the spinning nozzle 1 gets ready, the first high-voltage electrostatic generator 6 and the second high-voltage electrostatic generator 7 are turned on in turn to form a first level electric field between the spinning nozzle 1 and the first electrode plate 2 and second level electric field between the first electrode plate 2 and the second electrode plate 4, and under the action of an electric field force, the spinning nozzle 1 starts spinning, the threads are extended for the first time in the first level electric field, then the threads pass through the holes on the first electrode plate 2 and enter the second level electric field, where the threads are extended again, the threads are further thinned and finally fall on the fiber receiving plate 3 for being received.

During the falling of the fiber, multiple electrodes are employed to extend the fiber, and the fiber spun will be finer. By adjusting the distance between the electrode plate and the inner cone high-efficiency spinning nozzle and the distance between the electrode plates and adjusting the voltage of the high-voltage electrostatic generator, the fiber fineness may be adjusted to a certain degree.

Moreover, the fiber receiving device may be a flat plate (as shown in FIG. 1), or a mesh placement apparatus, or a roller (as shown in FIG. 2); the fiber receiving device is placed above the second electrode plate (as shown in FIG. 1); or the second electrode plate is substituted with the electrode plate with holes in the middle thereof, for example, the second electrode plate is substituted with a third electrode plate 8 with holes in the middle thereof (as shown in FIG. 2), and the collection of fibers is realized under the third electrode plate 8; in other words, the fiber receiving device is placed under the last layer of electrode plate for collecting spinning, and this makes the collection of fibers diversified to be applicable for different requirements.

The first electrode plate is an electrode plate with holes in the middle thereof, and the shape thereof may be a circle, a rectangle, a triangle or any other polygons.

The second electrode plate may be an electrode plate with holes in the middle thereof or a flat plate without holes in the middle thereof, and the shape thereof may be a circle, a rectangle, a triangle or any other polygons. The second electrode plate 4 is placed under the fiber receiving plate 3, such that the threads (fiber threads) will be acted by a pulling force when reaching the fiber receiving plate, and the threads will be stacked more densely on the fiber receiving plate.

The fibers may be collected by a flat plate, or may be collected continuously by a mesh placement apparatus, or may be collected by a roller, so that ordered-orientation collection of the fibers may be realized. When the linear velocity of the roller is greater than the falling speed of the fibers, the fibers will be further stretched and thus be finer.

Figure 6:
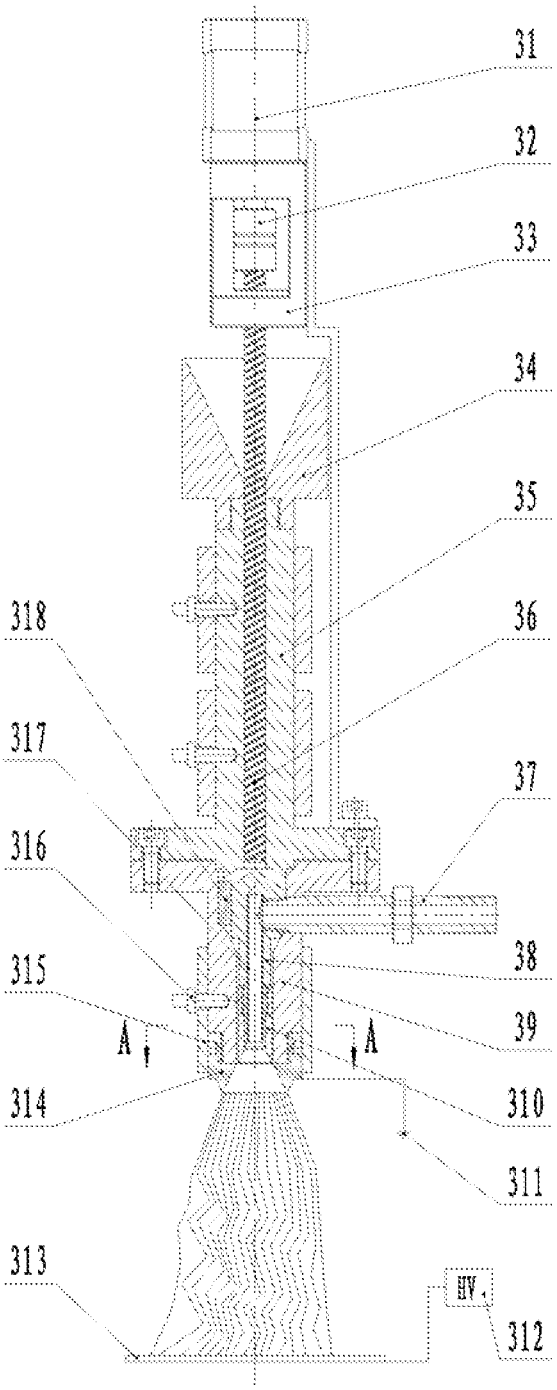
FIG. 6 is a structural representation of a spinning nozzle of a melt differential electrospinning device according to embodiment 3 of the invention.
Figure 7:
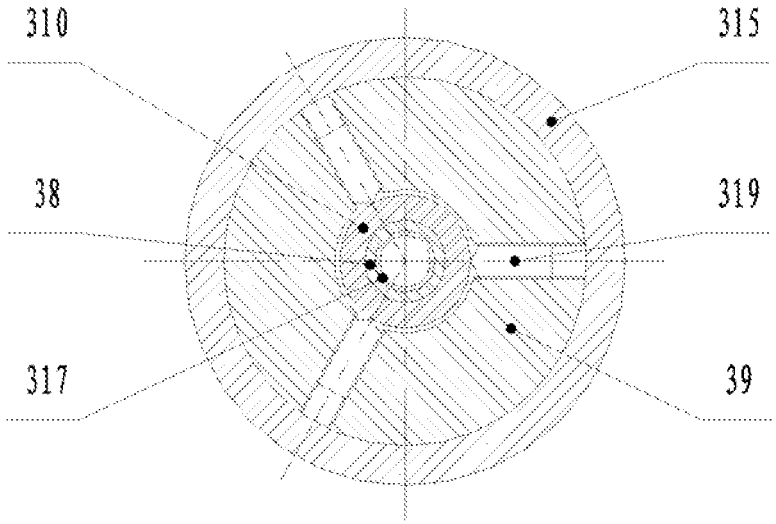
FIG. 7 is a sectional view along A-A of FIG. 6.

Moreover, as shown in FIG. 6 and FIG. 7, a melt differential electrospinning device includes: a hopper 34, a feed cylinder 35, a nozzle body 39, a first nozzle (for example, an inner cone nozzle 314), an airflow channel air-supply pipe 37, an airflow channel stand pipe 38, an airflow channel heat-insulating layer 317, a nozzle inner body 310, a key 318, a jack screw 319, a heating device 315, a temperature sensor 316, a threaded rod 36, a shaft coupling 32, a servo motor 31, a motor support 33, a grounding electrode 311, a receiving electrode plate 313 and a high-voltage electrostatic generator 312; wherein the airflow channel stand pipe 38 and the nozzle inner body 310 are connected via screw thread and mounted in the nozzle body 39, the key 318 is mounted between the airflow channel stand pipe 38 and the nozzle body 39 to position the airflow channel stand pipe 38 and the nozzle body 39, thus the airflow channel stand pipe 38 may be prevented from rotating and being misplaced, the airflow channel air-supply pipe 37 passes through the nozzle body 39 and is connected with the airflow channel stand pipe 38 via screw thread, the airflow channel heat-insulating layer 317 is located in the airflow channel stand pipe 38 and the nozzle inner body 310 to isolate the influence of the rapid flow of hot air on the temperature of the nozzle body 39, the first nozzle is connected with the nozzle body 39 via screw thread, three jack screws 319 are mounted on the nozzle body 39, and the three jack screws 319 are uniformly distributed along the periphery and jack the nozzle inner body 310, for adjusting the uniformity of the annular gap between the nozzle body 39 and the nozzle inner body 310, the feed cylinder 35 is connected with the nozzle body 39 via a screw, the hopper 34 is connected with the feed cylinder 35 via screw thread, the threaded rod 36 is located in the feed cylinder 35, the threaded rod 36 is connected with the servo motor 31 via the shaft coupling 32, the servo motor 31 is mounted on the motor support 33, and the motor support 33 is fixed on the flat plate of the feed cylinder 35 via a screw; the first nozzle is connected with the grounding electrode 311, the receiving electrode plate 313 is fixed at a certain distance under the first nozzle, the receiving electrode plate 313 is connected with the high-voltage positive terminal of the high-voltage electrostatic generator 312, the airflow channel air-supply pipe 37 is connected with an external hot air source, and the heating device 315 and the temperature sensor 316 are connected with a temperature control box.

During spinning, the heating device 315 is turned on, and the feed cylinder 35 and the nozzle body 39 are heated under the control of the temperature sensor 316; after the feed cylinder 35 and the nozzle body 39 are heated to a working temperature that is set, the servo motor 31 is turned on, the threaded rod 36 is driven to rotate at a rotating speed that is set, the spinning material is added to the hopper 34, and the spinning material, for example, melt blowing-purpose polypropylene (PP6315), melts and flows forward under the action of the threaded rod 36, the inner cone of the inner cone nozzle 314 is in communication with the annular gap formed between the nozzle inner body 310 and the nozzle body 39, the airflow channel stand pipe 38 is in communication with the annular gap and the inner cone of the inner cone nozzle 314, the spinning material melt passes through the airflow channel stand pipe 38 and the annular gap formed between the nozzle inner body 310 and the nozzle body 39 and reaches the inner cone of the inner cone nozzle 314, and the melt that reaches the inner cone is distributed uniformly by adjusting the three jack screws 319; the external hot air source is turned on, and hot air at a certain temperature is delivered to the airflow channel air-supply pipe 37; the high-voltage electrostatic generator 312 is turned on, so that the receiving electrode plate 313 is charged, and an electrostatic field is formed between the receiving electrode plate 313 and the inner cone nozzle 314, the melt forms Taylor cones under the combined action of the electric field and the wind field, and at this time, a circle of Taylor cones will be hung on the arris of the inner cone nozzle 314, and when the electric field force is greater than the surface tension of the melt, the Taylor cones will form a jet flow, thereby threads will be spun, and micro-nano level fibers will be received on the receiving electrode plate 13.

By being split via the inner cone nozzle 314, it may be realized that a single nozzle produces a plurality of fibers, the difficulty of single-needle machining may be decreased, and accurate and stable control on the nozzle temperature may be realized; at the same time, under the auxiliary action of the jetting of the center air flow, it may be realized that the spinning medium on the inner cone is sheared, the jet flow is accelerated and stretched on the jet flow path and the temperature of the jet flow path is controlled indirectly, thus the refining of fibers may be realized effectively, and the electrospinning efficiency of the single nozzle may be improved.

Moreover, the inner cone nozzle 314 is connected with the nozzle body 39 via screw thread, and the inner cone nozzle may be replaced, inner cone nozzles with different cone angles may be selected, the surface of the inner cone of the inner cone nozzle may be made smooth, or be made with grooves arranged densely with uniform strips for guiding the melt flow.

Moreover, the heating device may be an electric heating device or an electromagnetic heating device, or it may be heated indirectly via a gas or hot fluid flow medium; generally, the feed cylinder, the nozzle body and the inner cone nozzle are heated in multiple segments, and the temperature of each segment is precisely controlled by a temperature sensor, so that the melt may reach the optimal working temperature.

Moreover, feeding may be realized by a threaded rod or a plunger, or it may be realized via the self weight of the melt (i.e., spinning material).

Moreover, for the spinning nozzle, the material is fed at the center of the feed cylinder and wind is fed at the side edge of the feed cylinder, the annular gap through which the melt flows may be adjust via jack screws, thus it may be easy to guarantee the annular distribution uniformity of the melt; the wind fed at the side edge passes through the airflow channel stand pipe and then blows downward verticality onto the inner cone, thus the melt layer on the inner cone may be blown thin, which is favourable to spin finer threads; the wind blowing downward verticality can also have a certain extension effect on the threads spun during falling of the threads, and the thread will be finer; the wind can also have a certain guide effect on the falling of the threads.

Moreover, for the spinning nozzle, the material is fed at the center and wind is fed at the side edge, the melt is uniformly split via the inner cone, the melt on the inner cone is blown thin via the hot air, the threads are extended and guided to fall via the hot air, wherein the hot air may have a certain heat preservation action on the environment around the threads, the cooling of the threads may be slowed down, the acting time of extension on the threads may be prolonged, and the thread will be finer; a plurality of Taylor cones may be formed on the arris of the inner cone nozzle, thus a nozzle may spin a plurality of threads at a time, and high-efficiency spinning of a single nozzle may be realized.

Figure 3:
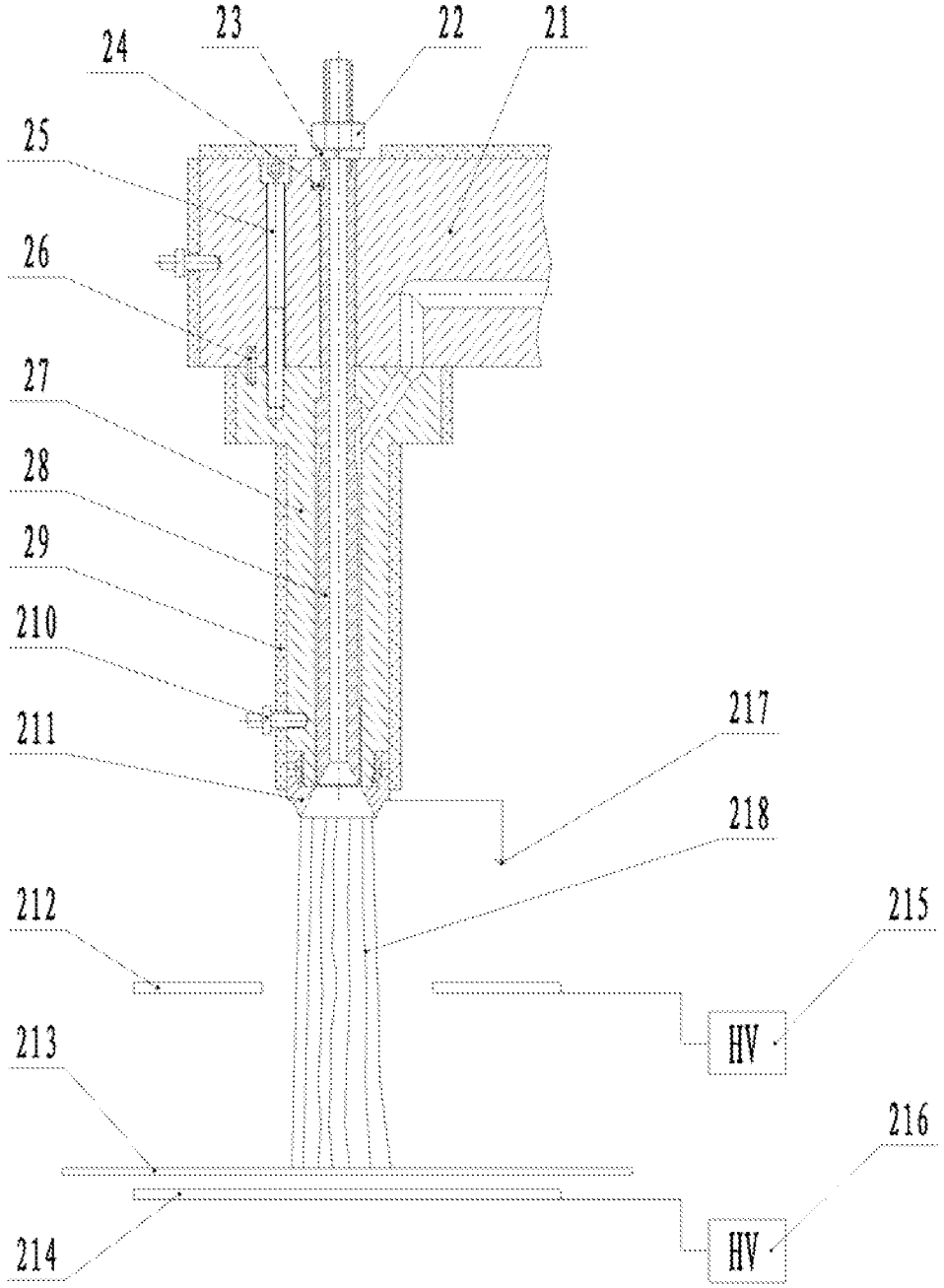
FIG. 3 is a structural representation of a melt differential electrospinning device according to embodiment 4 of the invention, wherein an inner cone nozzle is mounted on the nozzle body.
Figure 4:
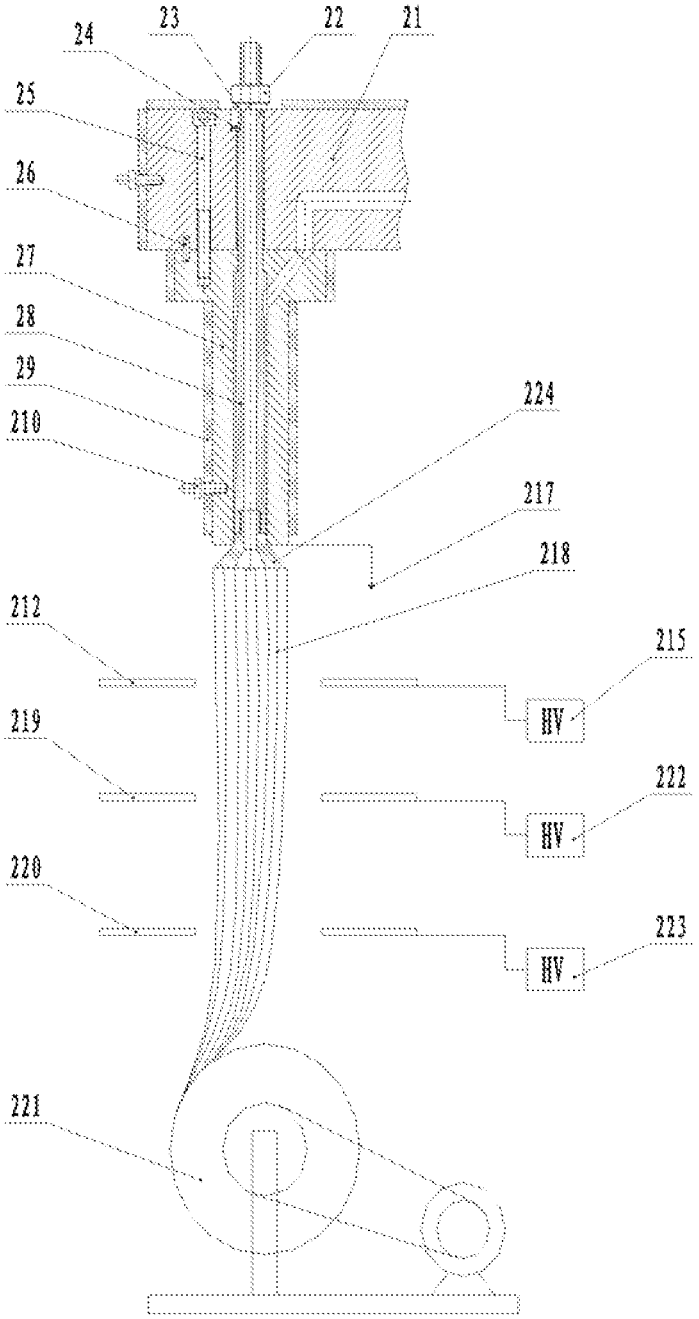
FIG. 4 is a structural representation of a melt differential electrospinning device according to embodiment 5 of the invention, wherein a male cone nozzle is mounted on the lower end of the air pipe.
Figure 5:
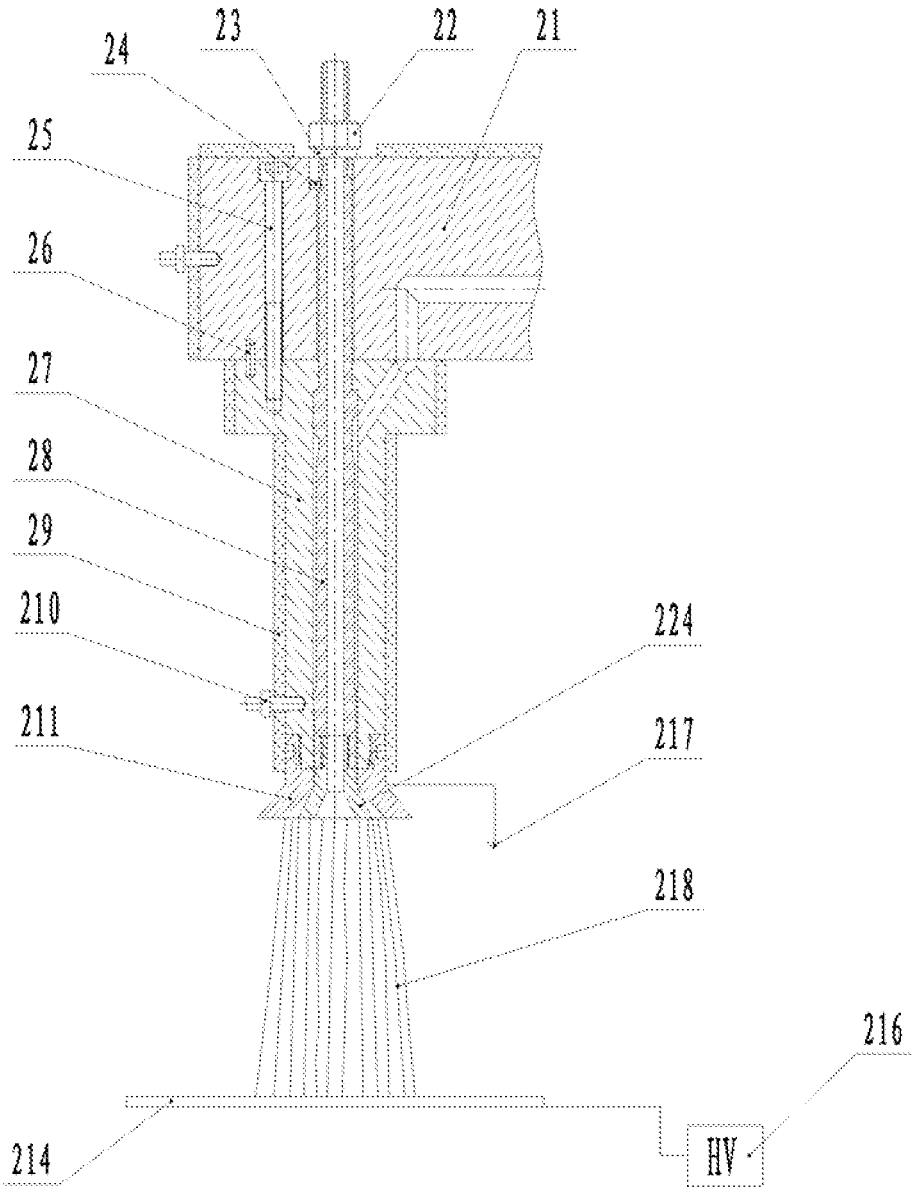
FIG. 5 is a structural representation of a melt differential electrospinning device according to embodiment 6 of the invention, wherein the joining mode of the male cone nozzle and the inner cone nozzle is shown.

Moreover, as shown in FIG. 3, FIG. 4 and FIG. 5, another spinning nozzle includes: a splitter plate 21, a nut 22, a spring spacer 23, an air pipe positioning pin 24, a screw 25, a nozzle body positioning pin 26, a nozzle body 27, an air pipe 28, a heating device 29, a temperature sensor 210 and a first nozzle (for example, an inner cone nozzle 211). The nozzle body 27 and the splitter plate 21 are positioned via the nozzle body positioning pin 26 and connected via the screw 25, the inlet of an oblique flow passage on the nozzle body 27 is in communication with the outlet of a subchannel on the splitter plate 21; the air pipe 28 is mounted in the inner holes of the nozzle body 27 and the splitter plate 21, an annular gap, in which the melt flows, is set between the external surface of the air pipe 28 and the inner hole of the nozzle body 27; the air pipe 28 is connected with the air pipe of the external hot air source via the screw thread on the upmost thereof, and the upmost end of the air pipe 28 is fixed with the spring spacer 23 via the nut 22 for preventing the air pipe 28 from falling down, a key groove is opened in the top part of the air pipe 28, the air pipe positioning pin 24 is mounted in the key groove for peripherally positioning the air pipe 28 and preventing the air pipe 28 from rotating and being misplaced; the inner cone nozzle 211 is connected with the nozzle body 27 via screw thread; the heating device 29 is wrapped outside the nozzle body 27 and the splitter plate 21, and the temperature sensor 210 is mounted for temperature control; the inner cone nozzle 211 is connected with the grounding electrode 217.

As shown in FIG. 3, FIG. 4 and FIG. 5, the melt differential electrospinning device containing such a spinning nozzle further includes: a first electrode plate 212, a second electrode plate 214, a first high-voltage electrostatic generator 215, a second high-voltage electrostatic generator 216 and a fiber receiving plate 213, wherein, the first electrode plate 212 is an electrode plate with holes in the middle thereof, the second electrode plate 214 may be an electrode plate with holes in the middle thereof or an electrode plate without holes in the middle thereof, and the shape of the first electrode plate 212 and the second electrode plate 214 may be a circle, a rectangle, a triangle or any other polygons; the first electrode plate 212 is mounted at a certain distance (0.5 to 10 cm) under the inner cone nozzle 211, the first electrode plate 212 is connected with the high-voltage positive terminal of the first high-voltage electrostatic generator 215, the second electrode plate 214 is mounted at a certain distance (5 to 70 cm) under the first electrode plate 212, the second electrode plate 214 is connected with the high-voltage positive terminal of the second high-voltage electrostatic generator 216, and the fiber receiving plate 213 is placed above the second electrode plate 214.

During spinning, the heating device 29 is turned on, and under the control of the temperature sensor 210, the splitter plate 21 and the nozzle body 27 are heated to working temperature, then the external hot air source is turned on to supply hot air at a certain temperature (60 to 400° C.) into the air pipe 28, and then a polymer melt is provided to the splitter plate via an extruder or other polymer melt plasticizing and supplying devices, the polymer melt is split via the subchannels in the splitter plate 21 and flows into the oblique flow passage of the nozzle body 27, and then flows into the annular gap between the air pipe 28 and the inner hole of the nozzle body 27, and finally flows onto the inner cone of the inner cone nozzle 211; the first high-voltage electrostatic generator 215 and the second high-voltage electrostatic generator 216 are turned on in turn to form a high-voltage electrostatic field between the first electrode plate 212 and the inner cone nozzle 211 and between the first electrode plate 212 and the second electrode plate 214, and at this time, under the action of the high-voltage electric field, the polymer melt will be uniformly distributed into a circle of dozens of Taylor cones along the lower end of the lateral side of the inner cone nozzle 211, and when the electric field force is greater than the surface tension of the melt, the Taylor cones will form a jet flow, thereby threads 218 will be spun; under the combined action of the wind field and the electric field force, the threads 218 pass through the holes on the first electrode plate 212 and fall onto the fiber receiving plate 213.

Further, the subchannels on the splitter plate 21 are a plurality of subchannels that are distributed uniformly, and a plurality of said spinning nozzles are mounted under one splitter plate 21. For example, a plurality of spinning nozzles with the structure shown in FIG. 6 and FIG. 7 are mounted under one splitter plate 21; however, because the splitter plate 21 has provided a plurality of subchannels, the feeding problem of each spinning nozzle shown in FIG. 6 and FIG. 7 has been solved, so that the hopper and the feed cylinder may be saved under the premise that the feeding channels are unified for each spinning nozzle.

Moreover, as shown in FIG. 3, the first nozzle is an inner cone nozzle 211, the polymer melt flows to the annular gap between the air pipe and the inner hole of the nozzle body along the passage, and finally flows onto the inner cone of the inner cone nozzle; moreover, the material is fed at the center of the feed cylinder and wind is fed at the side edge of the feed cylinder, the wind fed at the side edge passes through the airflow channel stand pipe and then blows downward verticality onto the inner cone of the first nozzle. The wind fed at the side edge passes through the airflow channel stand pipe and then blows downward verticality onto the inner cone, thus the melt layer on the inner cone may be blown thin, which is favourable to spin finer threads; the wind blowing downward verticality can also have a certain extension effect on the threads spun during falling of the threads, and the thread will be finer; the wind can also have a certain guide effect on the threads.

The hot air may have a certain heat preservation action on the environment around the threads, the cooling of the threads may be slowed down, the acting time of extension on the threads may be prolonged, and the thread will be finer; a plurality of Taylor cones may be formed on the arris of the inner cone nozzle, thus a nozzle may spin a plurality of threads at a time, and high-efficiency spinning of a single nozzle may be realized.

The inner cone nozzle of the spinning nozzle may also be substituted with a male cone nozzle, that is, the inner cone nozzle connected with the nozzle body is removed, and a male cone nozzle is connected on the bottom end of the air pipe via screw thread, the melt passes through the male cone of the male cone nozzle, a circular hole and a coniform hole for a gas to pass through are set inside the male cone nozzle, the nozzle body is connected with the grounding electrode, and the rest of the structure may be the same as that of the melt differential electrospinning nozzle in FIG. 3 (based on this, the number of electric fields is added and the fiber receiving plate 213 is replaced by a roller 221). As shown in FIG. 4, the first nozzle is a male cone nozzle 224, the polymer melt flows to the annular gap between the air pipe and the inner hole of the nozzle body along the passage and finally flows onto the male cone of the male cone nozzle 224, then under the action of gravity, it flows to the bottom edge of the male cone nozzle 224, a circular hole and a coniform hole for a gas to pass through, which can be in communication with the air pipe, are set inside the inner cone of the male cone nozzle 224, therefore, under the combined action of the wind field and the multiple levels of electric fields, the melt flowing to the bottom edge of the male cone nozzle 224 forms Taylor cones, and when the electric field force is greater than the surface tension of the melt, the Taylor cones will form a jet flow, thereby threads will be spun, and micro-nano level fibers will be received on the fiber receiving plate 213. More jet flows may be obtained on unit length of arc line on the male cone, and the efficiency will be higher relative to the inner cone.

Moreover, FIG. 5 shows the joining mode of the male cone nozzle and the inner cone nozzle. As shown in FIG. 5, the first nozzle is an inner cone nozzle 211, the bottom end of the air pipe 28 is further connected with a male cone nozzle 224 via screw thread, a circular hole and a coniform hole for a gas to pass through are set inside the male cone nozzle 224, the inner cone nozzle 211 is sleeved outside the male cone nozzle 224, the polymer melt flows into the annular gap between the air pipe 28 and the inner hole of the nozzle body 27 along the passage and finally flows onto the male cone of the male cone nozzle 224 and the inner cone of the inner cone nozzle 211. The threads formed of the melt on the two cones are both extended by the gas, and under the action of the wind force and multiple levels of electric fields, the threads are jetted from the male cone of the male cone nozzle 224 and the inner cone of the inner cone nozzle 211. Thus, jet flows may be generated by both the inner cone and the male cone, fibers may be prepared, and the efficiency and output may be increased.

In the melt differential electrospinning device of FIG. 3 to FIG. 5, the subchannel on the splitter plate may be a plurality of subchannels that are distributed uniformly, a plurality of melt differential electrospinning nozzles may be mounted under one splitter plate, and the melt may be supplied to a plurality of melt differential electrospinning nozzles at the same time by an extruder or other polymer melt plasticizing and supplying devices after being split by the subchannels inside the splitter plate, thereby batch production of superfine fibers may be realized.

Moreover, the first electrode plate is an electrode plate with holes in the middle thereof, and the shape thereof may be a circle, a rectangle, a triangle or any other polygons.

Moreover, the second electrode plate may be an electrode plate with holes in the middle thereof or a flat plate without holes in the middle thereof, and the shape thereof may be a circle, a rectangle, a triangle or any other polygons.

Moreover, the fibers may be collected above the second electrode plate, or the second electrode plate may be substituted with the electrode plate with holes in the middle thereof, the collection of fibers may be realized under the second electrode plate, and the fibers may be collected by a flat plate, or may be collected continuously by a mesh placement apparatus, or may be collected by a roller.

Moreover, n layers of electrode plates (with n being an integer and $n \geq 1$) may be set under the melt differential electrospinning nozzle, and multiple levels of electric fields are formed, the fiber may be extended for multiple times and thus be refined.

Moreover, the melt differential electrospinning device of FIG. 3 to FIG. 5 may be used for melt electrospinning, or it may also be used for solution electrospinning; during solution spinning, the heating device may not be powered on, or temperature control may be performed according to the requirement of solution spinning.

The melt differential electrospinning device according to the invention has the advantages as follows:

1) The components of the melt differential electrospinning nozzle are connected via screw thread by employing a pin and a key, etc., and a positioning screw, etc., thus the structure is simple, the components is easy to machine and assemble, and the production cost is low.

2) The polymer melt flows through the inner cone, and under the action of an electric field force, the polymer melt is finally distributed uniformly into a circle of dozens of Taylor cones along the cone end and is thereby formed into dozens of jet flows and refined into nanofibers, thus the output of a single melt differential electrospinning nozzle is high; By mounting a plurality of melt differential electrospinning nozzles under the splitter plate, batch production of nanofibers may be realized, and the output of a device with the equivalent scale is one order of magnitude larger than that of an electrospinning device of the same type.

3) By grounding the melt differential electrospinning nozzle and connecting the electrode plate to a positive high voltage, it may be effectively avoided that an electric apparatus is influenced and damaged when the nozzle is connected to a high voltage during electrospinning.

4) During the falling of the fiber, the fiber is extended by a multi-electric field coupling strong extension device, thus the fiber spun will be finer. By adjusting the distance from the electrode plate to the inner cone nozzle and the distance between electrode plates and adjusting the voltage of the high-voltage electrostatic generator, the fiber fineness may be adjusted to a certain degree.

5) By employing an electrode with holes, the fibers are received under the electrode, and this makes the collection modes of fibers diversified, and the fibers may be made in bundles during falling via the assistant extending of air flow, which is convenient for being wound for different requirements.

6) The device and process are easy and convenient for implementing, and thus are applicable for laboratory research and industrialized application.

The invention further provides a spinning process of a melt differential electrospinning device, wherein a polymer melt is provided to the splitter plate via a polymer melt plasticizing and supplying device, and the external hot air source is turned on to supply hot air at a certain temperature into the air pipe; after being split by the subchannels in the splitter plate, the polymer melt flows into the oblique flow passage of the nozzle body, then flows into the annular gap between the air pipe and the inner hole of the nozzle body, and finally flows onto the cone of the inner cone nozzle; the first high-voltage electrostatic generator and the second high-voltage electrostatic generator are turned on in turn to form a high-voltage electrostatic field between the first electrode plate and the inner cone nozzle and between the first electrode plate and the second electrode plate, the polymer melt is uniformly distributed into a circle of dozens of Taylor cones along the lower end of the lateral side of the inner cone nozzle, thereby the spinning material melt is jetted into threads; then, under the combined action of the wind field and the electric field force, the threads pass through the holes on the first electrode plate and fall onto a fiber receiving plate; by setting a plurality of electrode plates with holes in the middle thereof under the melt differential spinning nozzle, multiple levels of electric fields are formed, and the threads spun by the melt differential spinning nozzle are extended for multiple times; the fiber fineness is adjusted and controlled by controlling the distance between the electrode plates and the voltage applied on the electrode plate.

Several specific embodiments of the invention will be further described in detail below.

Embodiment 1

As shown in FIG. 1, the melt differential electrospinning device according to this embodiment mainly includes: a spinning nozzle 1, a first electrode plate 2, a second electrode plate 4, a first high-voltage electrostatic generator 6, a second high-voltage electrostatic generator 7, a fiber receiving plate 3 and a grounding electrode 5; wherein, the first electrode plate 2 is an electrode plate with holes in the middle thereof, the second electrode plate 4 may be an electrode plate with holes in the middle thereof or an electrode plate without holes in the middle thereof, the shape of the first electrode plate 2 and the second electrode plate 4 may be a circle, a rectangle, a triangle or any other polygons; the spinning nozzle 1 is connected with the grounding electrode 5, the first electrode plate 2 is mounted at a certain distance under the spinning nozzle 1, the first electrode plate 2 is connected with the high-voltage positive terminal of the first high-voltage electrostatic generator 6, the second electrode plate 4 is mounted at a certain distance under the first electrode plate 2, and the second electrode plate 4 is connected with the high-voltage positive terminal of the second high-voltage electrostatic generator 7, the fiber receiving plate 3 is placed above the second electrode plate 4.

During spinning, after the spinning nozzle 1 gets ready, the first high-voltage electrostatic generator 6 and the second high-voltage electrostatic generator 7 are turned on in turn to form a first level electric field between the spinning nozzle 1 and the first electrode plate 2 and second level electric field between the first electrode plate 2 and the second electrode plate 4, and under the action of an electric field force, the spinning nozzle 1 starts spinning, the threads are extended for the first time in the first level electric field, then pass through the circular holes on the first electrode plate 2, and enter the second level electric field, where the threads are extended again, thus the threads are further thinned and finally fall on the fiber receiving plate 3 for being received.

Embodiment 2

As shown in FIG. 2, the operational principle of this embodiment is the same as that of Embodiment 1, except that, three layers of electrode plates, i.e., the first electrode plate 2, the third electrode plate 8 and the fourth electrode plate 9, are set under the spinning nozzle, and the three electrode plates are all electrode plates with holes in the middle thereof, and a roller 10 is mounted under the fourth electrode plate 9 for receiving the fibers. During spinning, the spinning nozzle 1 is connected with the grounding electrode 5, the first electrode plate 2 is connected with the high-voltage positive terminal of the first high-voltage electrostatic generator 6, the third electrode plate 8 is connected with the high-voltage positive terminal of the third high-voltage electrostatic generator 11, and the fourth electrode plate 9 is connected with the high-voltage positive terminal of the fourth high-voltage electrostatic generator 12; when the spinning nozzle gets ready, the first high-voltage electrostatic generator 2, the third high-voltage electrostatic generator 8 and the fourth high-voltage electrostatic generator 9 are turned on in turn, and at the same time, the motor of the roller 10 is turned on, and under the action of an electric field force, the spinning nozzle 1 spins threads, and the threads are extended for three times under the action of the three-level electric field, pass through the holes on the three layers of electrode plates in turn, and finally are received by the roller 10 under the fourth electrode plate 9.

Embodiment 3

As shown in FIG. 6 and FIG. 7, the melt differential electrospinning device according to this embodiment mainly includes: a hopper 34, a feed cylinder 35, a nozzle body 39, a first nozzle (for example, inner cone nozzle 314), an airflow channel air-supply pipe 37, an airflow channel stand pipe 38, an airflow channel heat-insulating layer 317, a nozzle inner body 310, a key 318, a jack screw 319, a heating device 315, a temperature sensor 316, a threaded rod 36, a shaft coupling 32, a servo motor 31, a motor support 33, a grounding electrode 311, a receiving electrode plate 313 and a high-voltage electrostatic generator 312.

Wherein, the airflow channel stand pipe 38 and the nozzle inner body 310 are connected via screw thread and mounted in the nozzle body 39, the key 318 is mounted between the airflow channel stand pipe 38 and the nozzle body 39 to position the airflow channel stand pipe 38 and the nozzle body 39, thus the airflow channel stand pipe 38 may be prevented from rotating and being misplaced, the airflow channel air-supply pipe 37 passes through the nozzle body 39 and is connected with the airflow channel stand pipe 38 via screw thread, the airflow channel heat-insulating layer 317 is located in the airflow channel stand pipe 38 and the nozzle inner body 310 to isolate the influence of the rapid flow of hot air on the temperature of the nozzle body 39, the first nozzle is connected with the nozzle body 39 via screw thread, three jack screws 319 are mounted on the nozzle body 39, and the three jack screws 319 are uniformly distributed along the periphery and jack the nozzle inner body 310 for adjusting the uniformity of the annular gap between the nozzle body 39 and the nozzle inner body 310, the feed cylinder 35 is connected with the nozzle body 39 via a screw, the hopper 34 is connected with the feed cylinder 35 via screw thread, the threaded rod 36 is located in the feed cylinder 35, the threaded rod 36 is connected with the servo motor 31 via the shaft coupling 32, the servo motor 31 is mounted on the motor support 33, and the motor support 33 is fixed on the flat plate of the feed cylinder 35 via a screw; the first nozzle is connected with the grounding electrode 311, the receiving electrode plate 313 is fixed at a certain distance under the first nozzle, the receiving electrode plate 313 is connected with the high-voltage positive terminal of the high-voltage electrostatic generator 312, the airflow channel air-supply pipe 37 is connected with an external hot air source, and the heating device 315 and the temperature sensor 316 are connected with a temperature control box.

During spinning, the heating device 315 is turned on, and the feed cylinder 35 and the nozzle body 39 are heated under the control of the temperature sensor 316; after the feed cylinder 35 and the nozzle body 39 are heated to a working temperature that is set, the servo motor 31 is turned on, the threaded rod 36 is driven to rotate at a rotating speed that is set, and the spinning material is added to the hopper 34, the spinning material melts and flows forward under the action of the threaded rod 36, the spinning material melt passes through the airflow channel stand pipe 38 and the annular gap formed between the nozzle inner body 310 and the nozzle body 39 and reaches the inner cone of the inner cone nozzle 314, and the melt that reaches the inner cone is distributed uniformly by adjusting the three jack screws 319; the external hot air source is turned on, and hot air at a certain temperature is delivered to the airflow channel air-supply pipe 37; the high-voltage electrostatic generator 312 is turned on, so that the receiving electrode plate 313 is charged, an electrostatic field is formed between the receiving electrode plate 313 and the inner cone nozzle 314, the melt forms Taylor cones under the combined action of the electric field and the wind field, and at this time, a circle of Taylor cones will be hung on the arris of the inner cone nozzle 314, and when the electric field force is greater than the surface tension of the melt, the Taylor cones will form a jet flow, thereby threads will be spun, and micro-nano level fibers will be received on the receiving electrode plate 13.

Moreover, as shown in FIG. 6 and FIG. 7, the external diameter of the nozzle body 9 is 36 mm, the temperature of the feed cylinder 5 is set at 200° C., the temperature of the nozzle body 9 is set at 240° C., melt blowing-purpose polypropylene (PP6315) is added to the hopper 4, the rotating speed of the threaded rod 6 is set at 20 r/min, the temperature of the hot air is set at 80° C., the flow velocity of the hot air is set at 200 m/s, the distance from the receiving electrode plate 13 to the inner cone nozzle 14 is set as 15 cm, a voltage of 60 Kv is applied to the high-voltage electrostatic generator 12, and under the combined action of the electric field force and the hot air, and 30-40 threads are spun on the inner cone nozzle 14 simultaneously, the diameter of the threads may reach about 500 nm-1 μm, and the spinning efficiency is about 20 g/h.

Embodiment 4

As shown in FIG. 3, the melt differential electrospinning device according to this embodiment mainly includes: a splitter plate 21, a nut 22, a spring spacer 23, an air pipe positioning pin 24, a screw 25, a nozzle body positioning pin 26, a nozzle body 27, an air pipe 28, a heating device 29, a temperature sensor 210, an inner cone nozzle 211, a first electrode plate 212, a second electrode plate 214, a first high-voltage electrostatic generator 215, a second high-voltage electrostatic generator 216 and a fiber receiving plate 213.

The nozzle body 27 and the splitter plate 21 are positioned via the nozzle body positioning pin 26 and connected via the screw 25, and the inlet of an oblique flow passage on the nozzle body 27 is in communication with the outlet of a subchannel on the splitter plate 21; the air pipe 28 is mounted in the inner holes of the nozzle body 27 and the splitter plate 21, an annular gap, in which the melt flows, is set between the external surface of the air pipe 28 and the inner hole of the nozzle body 27; the air pipe 28 is connected with the air pipe of the external hot air source via the screw thread on the upmost thereof, and the upmost end of the air pipe 28 is fixed with the spring spacer 23 via the nut 22 for preventing the air pipe 28 from falling down, a key groove is opened in the top part of the air pipe 28, the air pipe positioning pin 24 is mounted in the key groove for peripherally positioning the air pipe 28 and preventing the air pipe 28 from rotating and being misplaced; the inner cone nozzle 211 is connected with the nozzle body 27 via screw thread; the heating device 29 is wrapped outside the nozzle body 27 and the splitter plate 21, and the temperature sensor 210 is mounted for temperature control; the inner cone nozzle 211 is connected with the grounding electrode 217.

The first electrode plate 212 is an electrode plate with holes in the middle thereof, the second electrode plate 214 may be an electrode plate with holes in the middle thereof or an electrode plate without holes in the middle thereof, and the shape of the first electrode plate 212 and the second electrode plate 214 may be a circle, a rectangle, a triangle or any other polygons; the first electrode plate 212 is mounted at a certain distance (0.5 to 10 cm) under the inner cone nozzle 211, the first electrode plate 212 is connected with the high-voltage positive terminal of the first high-voltage electrostatic generator 215, the second electrode plate 214 is mounted at a certain distance (5 to 70 cm) under the first electrode plate 212, the second electrode plate 214 is connected with the high-voltage positive terminal of the second high-voltage electrostatic generator 216, and the fiber receiving plate 213 is placed above the second electrode plate 214.

During spinning, the heating device 29 is turned on, and under the control of the temperature sensor 210, the splitter plate 21 and the nozzle body 27 are heated to working temperature, then the external hot air source is turned on to supply hot air at a certain temperature (60 to 400° C.) into the air pipe 28, and then a polymer melt is provided to the splitter plate via an extruder or other polymer melt plasticizing and supplying devices, the polymer melt is split via the subchannels in the splitter plate 21 and flows into the oblique flow passage of the nozzle body 27, and then flows into the annular gap between the air pipe 28 and the inner hole of the nozzle body 27, and finally flows onto the inner cone of the inner cone nozzle 211; the first high-voltage electrostatic generator 215 and the second high-voltage electrostatic generator 216 are turned on in turn to form a high-voltage electrostatic field between the first electrode plate 212 and the inner cone nozzle 211 and between the first electrode plate 212 and the second electrode plate 214, and at this time, under the action of the high-voltage electric field, the polymer melt will be uniformly distributed into a circle of dozens of Taylor cones along the lower end of the lateral side of the inner cone nozzle 211, and when the electric field force is greater than the surface tension of the melt, the Taylor cones will form a jet flow, thereby threads 218 will be spun; under the combined action of the wind field and the electric field force, the threads 218 pass through the holes on the first electrode plate 212 and fall onto the fiber receiving plate 213.

For example, for melt blowing-level PP, the diameter at the lower end of the inner cone nozzle 211 is 2.5 cm, the distance from the first electrode plate 212 to the lower end of the lateral side of the inner cone nozzle 211 is 4 cm, the distance from the second electrode plate 214 and the first electrode plate 212 is 15 cm, the temperature of the splitter plate 21 is set at 220° C., the temperature of the nozzle body 27 is set at 240° C., a 30 Kv high-voltage static electricity is applied to the first high-voltage electrostatic generator 215, a 65 Kv high-voltage static electricity is applied to the second high-voltage electrostatic generator 216, hot air at 80° C. is blown into the air pipe, and finally fibers with a diameter of 300 nm to 800 nm may be spun, and the spinning efficiency of a single nozzle may reach 10 to 20 g/h.

Embodiment 5

As shown in FIG. 4, the structure, operational principle and effect of this embodiment are basically the same as tpipe of Embodiment 3, except that: the inner cone nozzle 211 may be substituted with a male cone nozzle 224, the male cone nozzle 224 is connected with the bottom end of the air pipe 28 via screw thread, the nozzle body 27 is connected with the grounding electrode 217, and the rest of the structure is the same as that of the above melt differential electrospinning nozzle.

The electrode plates include three layers of electrode plates, and a first electrode plate 212, a third electrode plate 219 and a fourth electrode plate 220 are in turn set under the male cone nozzle 224, and the three electrode plates are all electrode plates with holes in the middle thereof, wherein the first electrode plate 212 is connected with the high-voltage positive terminal of the first high-voltage electrostatic generator 215, the third electrode plate 219 is connected with the high-voltage positive terminal of the third high-voltage electrostatic generator 222, and the fourth electrode plate 220 is connected with the high-voltage positive terminal of the fourth high-voltage electrostatic generator 223, and a roller 221 is mounted under the fourth electrode plate 220 for receiving fibers.

During spinning, the polymer melt flows into the annular gap between the air pipe 28 and the inner hole of the nozzle body 27 along the passage and finally flows onto the male cone of the male cone nozzle 224; and at this time, the first high-voltage electrostatic generator 212, the third high-voltage electrostatic generator 222 and the fourth high-voltage electrostatic generator 223 are turned on in turn, and at the same time, the motor of the roller 221 is turned on; and at this time, under the action of the high-voltage electric field, the polymer melt is uniformly distributed into a circle of dozens of Taylor cones along the lower end of the lateral side of the male cone nozzle 224, and when the electric field force is greater than the surface tension of the melt, the Taylor cones will form a jet flow, thereby the spinning material melt is jetted into threads 218; then, under the combined action of the wind field and the electric field force, the threads 218 in turn pass through the holes on the first electrode plate 212, the third electrode plate 219 and the fourth electrode plate 220, where the threads 218 are extended for three times, and finally, the threads 218 are received by the roller 221 under the fourth electrode plate 223.

Embodiment 6

As shown in FIG. 5, in the melt differential electrospinning device according to this embodiment, the inner cone nozzle 211 and the male cone nozzle 224 may also be combined in one and the same spinning nozzle, the inner cone nozzle 211 is connected with the nozzle body 27 via screw thread, the male cone nozzle 224 is connected with the bottom end of the air pipe 28 via screw thread, and the rest of the structure is the same as that of the above melt differential electrospinning nozzle, for example, multiple levels of electric fields may be employed, and the threads may be collected via a flat plate, or may be collected continuously by a mesh placement apparatus, or may be collected by a roller. FIG. 5 only schematically shows a case in which a single-level electric field and a flat plate are used for collecting the threads. According the above embodiments, in this embodiment, the multiple levels of electric fields of the above embodiments may also be employed, a mesh placement apparatus may be employed for continuously collecting the threads, a roller may be employed for collecting the threads, and other reasonable structure of the above embodiments may also be employed.

The above description only shows some schematic and specific embodiments of the invention, rather than limiting the scope of the invention. Each component part of the invention may be combined under nonconflicting conditions. Various equivalent variations and modifications made by one skilled in the art without departing from the concept and principle of the invention will fall into the protection scope of the invention.

What is claimed is:

1. A melt differential electrospinning device, comprising:

a spinning nozzle comprising a nozzle body, a male cone nozzle and an inner cone nozzle sleeved outside the male cone nozzle, configured for making spinning material melt flow onto an outer cone surface of the male cone nozzle and an inner cone surface of the inner cone nozzle, wherein the inner cone surface of the inner cone nozzle has a conical shape opening wider in a downward direction, and the inner cone nozzle and the male cone nozzle are configured as a nested pair of cones;

a fiber receiving device;

a first high-voltage electrostatic generator, a second high-voltage electrostatic generator and a grounding electrode; and n layers of electrode plates including a first electrode plate and a second electrode plate, which are set under the spinning nozzle, with n being an integer greater than or equal to 2;

wherein, the first electrode plate is an electrode plate with holes in the middle thereof, the spinning nozzle is connected with the grounding electrode, the first electrode plate is mounted at a certain distance under the spinning nozzle, the first electrode plate is connected with a high-voltage positive terminal of the first high-voltage electrostatic generator, the second electrode plate is mounted at a certain distance under the first electrode plate, and the second electrode plate is connected with a high-voltage positive terminal of the second high-voltage electrostatic generator.

2. The melt differential electrospinning device according to claim 1, wherein, the fiber receiving device is a flat plate, or a mesh placement apparatus, or a roller; the fiber receiving device is placed above the second electrode plate; or the second electrode plate is substituted with the electrode plate with holes in the middle thereof, and the collection of fibers is realized under the second electrode plate.

3. The melt differential electrospinning device according to claim 1, wherein, the spinning nozzle further comprises: a hopper, a feed cylinder, an airflow channel air-supply pipe, an airflow channel stand pipe, an airflow channel heat-insulating layer, a nozzle inner body, a key, a jack screw, a heating device, a temperature sensor, a threaded rod, a shaft coupling, a servo motor and a motor support; wherein the airflow channel stand pipe and the nozzle inner body are connected via screw thread and mounted in the nozzle body, the key is mounted between the airflow channel stand pipe and the nozzle body to position the airflow channel stand pipe and the nozzle body, the airflow channel air-supply pipe passes through the nozzle body and is connected with the airflow channel stand pipe via screw thread, the airflow channel heat-insulating layer is located in the airflow channel stand pipe and the nozzle inner body, the male cone nozzle is connected with the nozzle body via screw thread, the jack screw is mounted on the nozzle body, the jack screw is uniformly distributed along the periphery, and the jack screw jacks the nozzle inner body to adjust the uniformity of the annular gap between the nozzle body and the nozzle inner body, the feed cylinder is connected with the nozzle body via a screw, the hopper is connected with the feed cylinder via screw thread, the threaded rod is located in the feed cylinder, and the threaded rod is connected with the servo motor via the shaft coupling, the servo motor is mounted on the motor support, and the servo motor is fixed on the flat plate of the feed cylinder via a screw; the male cone nozzle is connected with the grounding electrode, the airflow channel air-supply pipe is connected with an external hot air source, and the heating device and the temperature sensor are connected with a temperature control box.

4. The melt differential electrospinning device according to claim 1, wherein, the spinning nozzle further comprises: a splitter plate, a nut, a spring spacer, an air pipe positioning pin, a screw, a nozzle body positioning pin, an air pipe, a heating device, and a temperature sensor; the splitter plate is located above the nozzle body, the nozzle body and the splitter plate are positioned via the nozzle body positioning pin, the nozzle body and the splitter plate are connected via a screw, the nozzle body is set with an oblique flow passage through which the melt flows, the splitter plate is set with a subchannel, and the inlet of the oblique flow passage on the splitter plate is in communication with the outlet of the subchannel on the splitter plate; a hole for a gas to pass through is set inside the air pipe, the hole at the air outlet inside the air pipe is a coniform hole, the air pipe is mounted in the inner hole of the nozzle body and the splitter plate, an annular gap in which the melt flows is formed between the external surface of the air pipe and the inner hole of the nozzle body; the air pipe is connected with an air duct of external hot air source via the screw thread on the upmost thereof, the top of the air pipe is fixed with the spring spacer via a nut; a key groove is further opened on the top part of the air pipe, and an air pipe positioning pin or a key is mounted in the key groove; the male cone nozzle and the nozzle body are connected via screw thread; a heating device is wrapped outside the nozzle body and the splitter plate, and a temperature sensor is mounted for temperature control; and the first nozzle is connected with the grounding electrode.

5. The melt differential electrospinning device according to claim 4, wherein: the subchannels on the splitter plate are a plurality of subchannels that are distributed uniformly, and a plurality of spinning nozzles are mounted under one splitter plate.

6. The melt differential electrospinning device according to claim 4, wherein the bottom end of the air pipe is connected with the male cone nozzle via screw thread, a circular hole and a coniform hole for a gas to pass through are set inside the male cone nozzle, and the spinning material melt flows along the passage to the annular gap between the air pipe and the inner hole of the nozzle body and finally flows onto the outer cone surface of the male cone nozzle and the inner cone surface of the inner cone nozzle.

7. The melt differential electrospinning device according to claim 3, wherein, the material is fed at the center of the feed cylinder and wind is fed at the side edge of the feed cylinder, the wind fed at the side edge passes through the airflow channel stand pipe and then blows downward verticality onto the outer cone surface of the male cone nozzle.

8. A melt differential electrospinning process, which employs the melt differential electrospinning device according to claim 7, wherein:

a polymer melt is provided to the splitter plate via a spinning material melt plasticizing and supplying device, wherein: the external hot air source is turned on to supply hot air at a certain temperature into the air pipe; after being split by the subchannels in the splitter plate, the spinning material melt flows into the oblique flow passage of the nozzle body, then flows into the annular gap between the air pipe and the inner hole of the nozzle body, and finally flows onto the cone of the first nozzle; the first high-voltage electrostatic generator and the second high-voltage electrostatic generator are turned on in turn to form a high-voltage electrostatic field between the first electrode plate and the first nozzle and between the first electrode plate and the second electrode plate, the spinning material melt is uniformly distributed into a circle of dozens of Taylor cones along the lower end of the lateral side of the first nozzle, thereby the spinning material melt is jetted into threads; then, under the combined action of the wind field and the electric field force, the threads pass through the holes on the first electrode plate and fall onto a fiber receiving plate; by setting a plurality of electrode plates with holes in the middle thereof under the melt differential spinning nozzle, multiple levels of electric fields are formed, and the threads spun by the melt differential spinning nozzle are extended for multiple times; the fiber fineness is adjusted and controlled by controlling the distance between the electrode plates and the voltage applied on the electrode plate.

9. A melt differential electrospinning device, mainly comprising:

a spinning nozzle comprising a nozzle body, a male cone nozzle and an inner cone nozzle sleeved outside the male cone nozzle, configured for making spinning material melt flow onto an outer cone surface of the male cone nozzle and an inner cone surface of the inner cone nozzle, wherein the inner cone surface of the inner cone nozzle has a conical shape opening wider in a downward direction, and the inner cone nozzle and the male cone nozzle are configured as a nested pair of cones, a first electrode plate, a second electrode plate, a first high-voltage electrostatic generator, a second high-voltage electrostatic generator, a fiber receiving device, and a grounding electrode, wherein, the first electrode plate is an electrode plate with holes in the middle thereof, and the second electrode plate is an electrode plate without holes in the middle thereof; the spinning nozzle is connected with the grounding electrode, the first electrode plate is mounted at a certain distance under the spinning nozzle, the first electrode plate is connected with a high-voltage positive terminal of the first high-voltage electrostatic generator, the second electrode plate is mounted at a certain distance under the first electrode plate, the second electrode plate is connected with a high-voltage positive terminal of the second high-voltage electrostatic generator, and the fiber receiving device is placed above the second electrode plate.

10. The melt differential electrospinning device according to claim 9, wherein: the second electrode plate is an electrode plate with holes in the middle thereof, and at this time, the collection of fibers is realized under the second electrode plate, and the fiber collecting device is a flat plate, or a mesh placement apparatus, or a roller.

11. The melt differential electrospinning device according to claim 9, wherein: n layers of electrode plates are set under the spinning nozzle, with n being an integer and n≥2.

12. The melt differential electrospinning device according to claim 9, wherein: the spinning nozzle further comprises: a splitter plate, a nut, a spring spacer, an air pipe positioning pin, a screw, a nozzle body positioning pin, an air pipe, a heating device, and a temperature sensor; the splitter plate is located above the nozzle body, the nozzle body and the splitter plate are positioned via the nozzle body positioning pin, the nozzle body and the splitter plate are connected via a screw, the nozzle body is set with an oblique flow passage through which the melt flows, the splitter plate is set with a subchannel, and the inlet of the oblique flow passage on the splitter plate is in communication with the outlet of the subchannel on the splitter plate; a hole for a gas to pass through is set inside the air pipe, the hole at the air outlet inside the air pipe is a coniform hole, the air pipe is mounted in the inner hole of the nozzle body and the splitter plate, an annular gap in which the melt flows is formed between the external surface of the air pipe and the inner hole of the nozzle body; the air pipe is connected with an air pipe via the screw thread on the upmost thereof, the top of the air pipe is fixed with the spring spacer via a nut; a key groove is further opened on the top part of the air pipe, and an air pipe positioning pin or a key is mounted in the key groove; the male cone nozzle is connected with the nozzle body via screw thread; a heating device is wrapped outside the nozzle body and the splitter plate, and a temperature sensor is mounted for temperature control; the male cone nozzle is connected with the grounding electrode.

13. The melt differential electrospinning device according to claim 9, wherein: the spinning nozzle comprises: a hopper, a feed cylinder, an airflow channel air-supply pipe, an airflow channel stand pipe, an airflow channel heat-insulating layer, a nozzle inner body, a key, a jack screw, a heating device, a temperature sensor, a threaded rod, a shaft coupling, a servo motor, a motor support, a grounding electrode, a receiving electrode plate and a high-voltage electrostatic generator; wherein the airflow channel stand pipe and the nozzle inner body are connected via screw thread and mounted in the nozzle body, the key is mounted between the airflow channel stand pipe and the nozzle body to position the airflow channel stand pipe and the nozzle body, the airflow channel air-supply pipe passes through the nozzle body and is connected with the airflow channel stand pipe via screw thread, the airflow channel heat-insulating layer is located in the airflow channel stand pipe and the nozzle inner body, the male cone nozzle is connected with the nozzle body via screw thread, the jack screw is mounted on the nozzle body, the jack screw is uniformly distributed along the periphery, and the jack screw jacks the nozzle inner body to adjust the uniformity of the annular gap between the nozzle body and the nozzle inner body, the feed cylinder is connected with the nozzle body via a screw, the hopper is connected with the feed cylinder via screw thread, the threaded rod is located in the feed cylinder, and the threaded rod is connected with the servo motor via the shaft coupling, the servo motor is mounted on the motor support, and the servo motor is fixed on the flat plate of the feed cylinder via a screw; the male cone nozzle is connected with the grounding electrode, the receiving electrode plate is fixed at a certain distance under the male cone nozzle, the receiving electrode plate is connected with the high-voltage positive terminal of the high-voltage electrostatic generator, the airflow channel air-supply pipe is connected with an external hot air source, and the heating device and the temperature sensor are connected with a temperature control box.

14. The melt differential electrospinning device according to claim 12, wherein: the subchannels on the splitter plate are a plurality of subchannels that are distributed uniformly, and a plurality of spinning nozzles are mounted under one splitter plate.

15. The melt differential electrospinning device according to claim 12, wherein, the material is fed by a threaded rod, or a plunger, or a minitype extruder, or by the self weight of the melt.

16. The melt differential electrospinning device according to claim 12, wherein: the male cone nozzle is mounted on the bottom end of the air pipe via screw thread, the melt passes through the outer cone surface of the male cone nozzle, a circular hole and a coniform hole for a gas to pass through are set inside the male cone nozzle, and the grounding electrode is connected with the nozzle body.

17. The melt differential electro spinning device according to claim 12, wherein the spinning material melt flows along the passage to the annular gap between the air pipe and the inner hole of the nozzle body, and finally flows onto the outer cone surface of the male cone nozzle and the inner cone surface of the inner cone nozzle.

18. The melt differential electro spinning device according to claim 1, wherein the outer cone surface of the male cone nozzle has a conical shape opening wider in the downward direction.

* * * * *